United States Patent [19]

Hansen et al.

[11] Patent Number: 4,702,673

[45] Date of Patent: Oct. 27, 1987

[54] METHOD FOR ASSEMBLY OF TANGENTIAL ENTRY DOVETAILED BUCKET ASSEMBLIES ON A TURBOMACHINE BUCKET WHEEL

[75] Inventors: Kurt L. Hansen, Schenectady; Ronald J. VanDenburgh, Ballston Lake, both of N.Y.

[73] Assignee: General Electric Company, Schenectady, N.Y.

[21] Appl. No.: 788,996

[22] Filed: Oct. 18, 1985

[51] Int. Cl.[4] ..... F04D 29/34

[52] U.S. Cl. ..... 416/215; 416/218; 29/156.8 R; 29/447

[58] Field of Search ..... 416/215, 216, 217, 222, 416/220 R; 29/156.8 R, 447, 526 R

[56] References Cited

U.S. PATENT DOCUMENTS

| | | | |
|---|---|---|---|
| 883,891 | 4/1908 | Kieser | 416/218 |
| 2,036,083 | 3/1936 | Robinson | 416/217 |
| 2,199,243 | 4/1940 | Mortimer | 416/222 |
| 2,220,918 | 11/1940 | Smith | 416/216 |
| 2,221,685 | 11/1940 | Smith | 416/222 |
| 2,393,447 | 1/1946 | Allen | 416/218 |
| 2,406,703 | 8/1946 | Morris | 416/218 |
| 2,844,355 | 7/1958 | Rankin | 416/216 |
| 4,157,122 | 6/1979 | Morris | 29/447 |
| 4,270,256 | 6/1981 | Ewing | 29/447 |
| 4,314,396 | 2/1982 | Nunlist et al. | 29/156.8 R |

FOREIGN PATENT DOCUMENTS

| | | | |
|---|---|---|---|
| 2164114 | 3/1986 | United Kingdom | 29/447 |

*Primary Examiner*—Robert E. Garrett
*Assistant Examiner*—John Kwon
*Attorney, Agent, or Firm*—Jerome C. Squillaro

[57] ABSTRACT

A method for assembling a plurality of bucket assemblies having tangential entry dovetails onto a wheel of a turbomachine such that a predetermined circumferential force is obtainable on the bucket assemblies when assembled, includes reducing the distance between lateral faces on the base portion of at least a first bucket assembly and preferably all bucket assemblies, such as by cooling, and increasing the distance between the lateral faces after assembly, so that the predetermined circumferential force is obtained. Alternatively, the wheel circumference may be increased as by heating before the bucket assemblies are assembled. A combination of appropriate heating and cooling may be used. A closure piece having a predetermined circumferential expanse may be inserted in the bucket row of the wheel to obtain the desired circumferential force.

16 Claims, 3 Drawing Figures

METHOD FOR ASSEMBLY OF TANGENTIAL ENTRY DOVETAILED BUCKET ASSEMBLIES ON A TURBOMACHINE BUCKET WHEEL

BACKGROUND OF THE INVENTION

This invention relates to assembly of turbine bucket assemblies having tangential entry dovetails onto a turbomachine bucket wheel and, more particularly, to a method for assembly such that relative motion between adjacent tangential entry dovetails and/or the bucket wheel is minimized at operational speed and temperature.

In an axial fluid flow turbine, such as a steam turbine, the blade elements, or vanes, may be secured to a dovetail assembly to form a bucket assembly. These bucket assemblies are mounted on the rim of a turbine wheel such that the bucket assemblies are radially inwardly inserted one at a time at a predetermined location on the rim, and are then circumferentially positioned in dovetail mounting grooves in the rim until there is a full circumferential row of bucket assemblies on the rim. With such a construction, the dovetail based portions of the bucket assemblies often have lateral planar faces lying in a plane parallel to a radial plane which abut similar faces of adjacent bucket assemblies, so that each bucket assembly is held circumferentially in place by bucket assemblies pressing against it on either side thereof. With this construction, it is desirable to have a tight structure in order to assure the correctness of the overall assembly, to determine the natural vibration frequencies, and to prevent any looseness which may lead to fretting or wear, resulting in undesirable consequences such as reduced fatigue strength of the material constituting the bucket assemblies or mating wheel.

In certain turbomachine applications, the aforedescribed type of turbine wheel construction may be subject to a phenomenon known as "arch binding", which causes a gradual increase in the diameter in the wheel to which the buckets are attached, resulting in increased compressive forces between dovetail assemblies. Apparatus for reducing the affects of arch binding by reducing the tangential compressive forces present in a bucket wheel is described in U.S. Pat. No. 3,084,343—Rubio et al, which is assigned to the present assignee. However, it is believed that the detrimental affects due to arch binding are not manifested until the bucket wheel experiences operating temperatures above about 700° F. Arch binding is also a function of the materials constituting the bucket assembly and wheel and their respective coefficients of thermal expansion. Arch binding is more likely to occur if the coefficient of thermal expansion for the bucket assembly is greater than the coefficient of thermal expansion for the wheel.

For certain bucket wheel applications, such as for operating at elevated temperatures and wherein the wheel coefficient of thermal expansion is greater than the bucket coefficient of thermal expansion, it may be desirable to increase the circumferential, or tangential compressive, force between the dovetail based portions of the bucket assemblies. One such apparatus for increasing the circumferential force exerted on a bucket wheel is described, especially with respect to FIG. 5 thereof, in U.S. Pat. No. 3,721,506—Anderson, which is assigned to the present assignee. Although the apparatus of the Anderson patent may be used in appropriate cases, it is desirable to increase the circumferential or tangential force between base portions of bucket assemblies circumferentially disposed on a dovetail of the rim of a bucket wheel without using additional hardware.

Accordingly, it is an object of the present invention to provide a method for assembling a plurality of bucket assemblies onto a wheel of an axial fluid flow turbine such that residual circumferential tightness is maintained between adjacent bucket assemblies at operating temperature and speed.

SUMMARY OF THE INVENTION

In accordance with the present invention, a method for assemblying a plurality of bucket assemblies having tangential entry dovetails onto a wheel of a turbomachine such that a predetermined circumferential force is obtainable on the plurality of bucket assemblies when assembled, includes reducing, such as by cooling, the distance between lateral faces on the base portion of at least a first bucket assembly, and preferably on all bucket assemblies, assembling the plurality of bucket assemblies onto the wheel and increasing, such as by heating, the distance between the lateral faces on the base portion of the at least a first bucket assembly and/or all bucket assemblies. Alternatively, or in combination with reducing the distance between lateral faces on the base portion of at least a first bucket assembly, the wheel diameter and thereby wheel circumference may be increased, such as by heating the wheel, prior to assembly of bucket assemblies on the wheel. A closure piece having a predetermined circumferential distance between lateral faces may be inserted in the bucket row of the wheel to obtain the desired predetermined circumferential force.

The features of the invention believed to be novel are set forth with particularity in the appended claims. The invention itself, however, both as to organization and method of operation, together with further objects and advantages thereof, may best be understood by reference to the detailed description taken in connection with the accompanying drawing.

DETAILED DESCRIPTION

Figure 1:
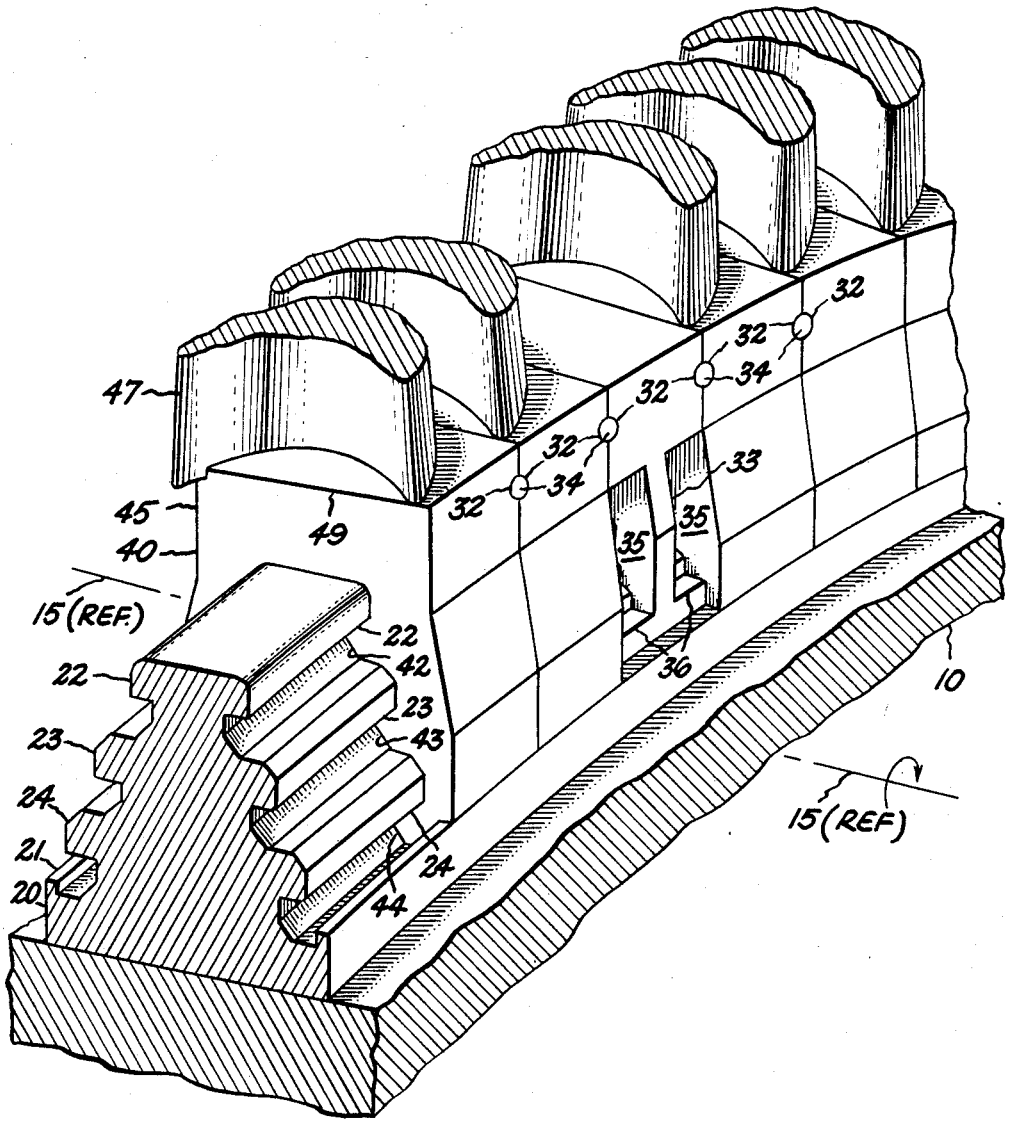
FIG. 1 is an elevational view of a partial turbine wheel and associated bucket assemblies in accordance with the present invention.

Referring to FIG. 1, a partial elevational view of an axial fluid flow turbine shows a turbine wheel 20 and a plurality of associated bucket assemblies 40, which circumferentially surround turbine wheel 20. The turbine comprises a rotor 10 having an axis of rotation 15 (shown for reference as parallel to the actual axis of rotation, it being understood that the actual axis of rotation 15 is generally disposed along the axial centerline of rotor 10). Rotor 10 has wheel 20 fixedly secured thereto, such as by an interference shrink fit and/or cooperating key and keyway (not shown). Alternatively, wheel 20 may be integral with rotor 10. Bucket assembly 40 includes a radially inner dovetail assembly 45 and a radially extending vane, or blade, 47 fixedly secured to dovetail assembly 45. Vane 47 is generally fabricated integral with dovetail assembly 45. An axial fluid flow turbine will typically include a plurality of wheels 20 and associated bucket assemblies 40 which are appropriately axially spaced along rotor 10. Wheel 20 includes a radially inner rim 21 and a plurality of hooks, or wheel hooks, 22, 23 and 24, which may be fabricated by undercutting a predetermined portion of wheel 20.

Bucket dovetail assembly 45 includes a plurality of hooks, or bucket hooks, 42, 43 and 44 for complimentary mating with wheel hooks 22, 23 and 24, respectively. Thus, hooks 42, 43 and 44 cooperate with wheel hooks 22, 23 and 24, respectively, to fixedly secure bucket assembly 40 to wheel 20. When assembled onto wheel 20, lateral surface 49 of bucket dovetail assembly 45 abuts a similar lateral surface on an adjacent bucket dovetail assembly. Likewise, a lateral surface of bucket dovetail assembly 45 disposed circumferentially opposite lateral surface 49 abuts a similar lateral surface on an adjacent bucket dovetail assembly.

A closure piece 30 is shown disposed between two bucket assemblies 40. Closure piece 30 may also be variously described in the literature as a notch piece, closure block, closure blade, filling piece or locking piece. Since closure piece 30 does not include hooks (as explained in detail below) to mate with wheel hooks 22, 23 and 24, closure piece 30 must be carried or supported against undesirable outward radial motion by bucket assemblies 40 adjacent closure piece 30. Closure piece 30 and appropriate adjacent bucket assemblies 40 include holes, or openings, 32 which extend transversely of bucket assemblies 40 and are formed partly in closure block 30 and in adjacent dovetail assemblies. Situated in holes 32 is a restraining pin, dowel, or cross key, 34. A more detailed description of holes 32 and cross key 34 may be had by reference to U.S. Pat. No. 1,415,266—Rice, assigned to the present assignee.

As shown in FIG. 1, closure piece 30 may lack a vane 47 extending radially outward therefrom in order to reduce the mass necessary to be supported by adjacent bucket assemblies 40 and cross keys 34. In order further to reduce the mass of closure piece 30, closure piece 30 may be relieved as at 35 so that radial brace 33 and opposing ribs 36 remain. Thus, when closure piece 30, is inserted between adjacent bucket assemblies 40, the radially outer circumferential lateral surfaces of closure piece 30 and the circumferential ends of opposing ribs 36 contact respective circumferential lateral surfaces of adjacent bucket assemblies 40. If desired, a vane 47 may be secured to, or fabricated integral with, closure piece 30 such that it radially outwardly extends therefrom.

Figure 2:
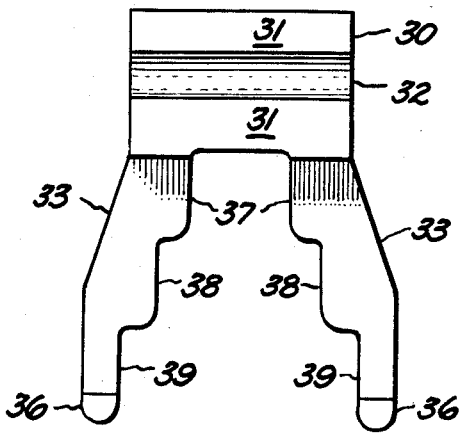
FIG. 2 is a tangential view of the closure piece of FIG. 1.

Referring to FIG. 2, a tangential view of closure piece 30 of FIG. 1 is shown. It is noted that hooks, or closure piece hooks, 37, 38 and 39 of closure piece 30 have been modified from hooks 42, 43 and 44 of dovetail assembly 45 to form a closure piece base portion so that closure piece 30 can be inserted from a radial direction into a notch 25 (FIG. 3) of wheel 20.

Figure 3:
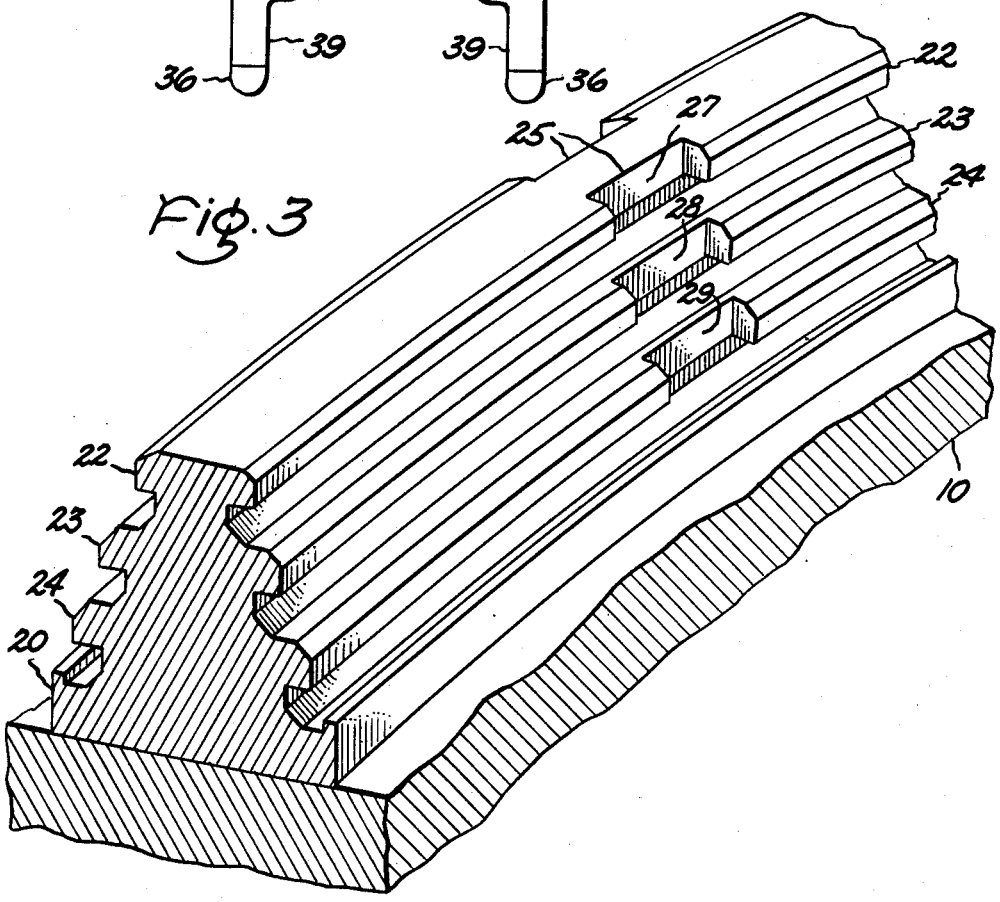
FIG. 3 is a view of the wheel of FIG. 1 with the bucket assemblies removed.

Referring to FIG. 3, wheel 20 with bucket assemblies 40 removed, is shown. Notch 25 is formed by a reduction in circumferentially extending wheel hooks 22, 23 and 24 such that notch surfaces 27, 28 and 29 are mutually registered. Notch surfaces 27, 28 and 29 circumferentially extend far enough so that dovetail assembly 45 may be radially inserted onto wheel 20 and circumferentially positioned to an appropriate assembly position along the circumference of wheel 20. After the plurality of bucket assemblies 40 have been assembled onto wheel 20 to substantially fill the row, closure piece 30 (FIG. 2) may be radially inserted into notch 25 such that hooks 37, 38 and 39 engage notch surfaces 27, 28 and 29, respectively. Cross keys 34 (FIG. 1) may then be assembled into holes 32, which are preferably fabricated, such as by reaming, after bucket assemblies 40 (FIG. 1) and closure piece 30 (FIG. 2) have been assembled onto wheel 20.

In certain applications, it is desirable to increase the circumferential, or tangential, force between adjacent bucket assemblies 40 in order to prevent movement of bucket assemblies 40 with respect to each other and/or with respect to wheel 20. Such respective movement, like axial or tangential rocking or a combination of both, may produce fretting or rubbing between adjacent bucket assemblies 40 and/or wheel 20 which reduces fatigue strength of the material constituting assemblies 40 and wheel 20, thereby producing a material more susceptible to cracking or other undesirable phenomena.

During operation of the axial fluid flow turbine, the fluid, which is typically hot, such as steam or another gas, heats wheel 20 causing it to expand, thereby increasing the circumferential dimension thereof. In a steam turbine, wheel 20 typically comprises a NiCrMoV alloy steel similar to ASTM type A470 and dovetail assembly 45 typically comprises 12 Cr alloy steel similar to AISI type 410, which have different thermal coefficients of expansion, the material of wheel 20 having the greater. Unequal expansion between wheel 20 and dovetail assembly 45 reduces the circumferential force on adjacent bucket assemblies 40 during operation of the turbine. In addition, centrifugal force during operation of the turbine tends to cause the diameter of wheel 20 to further increase. Increase in the diameter of, with attendant increase in the circumferential dimension of, wheel 20, tends to increase the circumferential clearance between adjacent bucket assemblies 40 resulting in a relatively loose fit between adjacent bucket assemblies 40 at operational speed and temperature of the turbine.

In accordance with the present invention, in order to maintain residual tightness between adjacent bucket assemblies 40 at operational temperature and speed, the circumferential dimension of closure piece 30 (FIG. 2) is predeterminedly selected. One way to determine the required circumferential dimension of closure block 30 is to assemble the entire plurality, or row, of bucket assemblies 40 onto wheel 20 at room temperature. The row of bucket assemblies 40 is checked for proper fit and the spacing remaining at notch 25 (FIG. 3) is measured. The required circumferential dimension of closure piece 30 is determined, in accordance with accepted engineering principles, to be greater than the opening remaining at notch 25 (FIG. 3) in order to provide a predetermined amount of interference fit between closure piece 30 (FIG. 1) and bucket assemblies 40 (FIG. 1) adjacent closure piece 30. Oversizing closure piece 30 (FIG. 1) for the opening remaining at notch 25 (FIG. 1) will produce a relatively large tangential force when closure block 30 and the row of bucket assemblies 40 are assembled. By adjusting the circumferential dimension of notch piece 30 with respect to the space remaining at notch 25 after assembly of bucket assemblies 40 onto wheel 20 at room temperature, the circumferential force between adjacent bucket assemblies 40 in the row of bucket assemblies 40 on wheel 20 may be predeterminedly controlled. The relatively large tangential force available at room temperature between adjacent bucket assemblies 40 and notch piece 30 after assembly will be reduced during operation at speed and temperature, but a desired residual tangential force will remain in the row of bucket assemblies 40, thereby preventing fretting or rubbing between adjacent bucket assemblies 40 and/or wheel 20.

In order to insert oversize closure piece 30 into the space remaining at notch 25 after bucket assemblies 40 are assembled onto wheel 20, wheel 20 may be maintained at room temperature while bucket assemblies 40 are cooled, such as disposing bucket assemblies 40 in heat flow communication with dry ice or liquid nitrogen. In general, any refrigerant or cryogenic material capable of producing the desired amount of cooling without adversely affecting, and that is compatible with, bucket assemblies 40 may be used. Dry ice, typically having a temperature of about −110° F., and liquid nitrogen, typically having a temperature of about −319° F., are both relatively inert with respect to materials of the turbine which they will contact and both are readily available. The temperature to which a component is actually cooled, and therefore the amount of dimension reduction, may be controlled by disposing the component for a predetermined time interval in heat flow communication with the refrigerant or cryogenic material used with a maximum dimension reduction reached when the component and cooling medium have attained temperature equilibrium. Cooling each bucket assembly 40 results in a predetermined incremental reduction in the circumferential dimension of bucket dovetail 45. Enough bucket assemblies 40 must be cooled so that the cumulative reduction in circumferential dimension of bucket dovetail 45 is adequate to permit oversize closure piece 30 to be inserted into the opening remaining at notch 25 when the plurality of bucket assemblies 40 are assembled on wheel 20. Alternatively, bucket assemblies 40 may be maintained at room temperature while wheel 20 is heated, such as to about 250° F. or more, an amount sufficient to permit insertion of bucket assemblies 40 onto wheel 20 and oversize closure piece 30 into the space remaining at notch 25. Also, an appropriate combination of heating and cooling of wheel 20 and bucket assemblies 40 may be used in order to insert closure piece 30 onto the wheel 20.

By providing appropriate heating and/or cooling of wheel 20 and bucket assemblies 40, the space remaining at notch 25 of wheel 20 between bucket assemblies 40 adjacent notch 25 will temporarily increase, permitting closure piece 30 to be inserted into notch 25. After insertion of closure piece 30 into notch 25, wheel 20, bucket assemblies 40 and closure piece 30 are allowed to achieve temperature equilibrium, such as room temperature. The interference fit between closure piece 30 and bucket assemblies 40 which is obtained at temperature equilibrium, produces a relatively high tangential force in the row of bucket assemblies 40.

In one application of the present invention, 72 bucket assemblies and a closure piece were assembled onto a wheel having a diameter of 58 inches. The bucket assemblies were cooled to about −319° F. using liquid nitrogen which permitted the closure piece having an circumferential interference of about 0.185 inches to be assemblied in the row. The entire assembly was allowed to attain room temperature.

Thus has been illustrated and described a method for assembling a plurality of bucket assemblies onto a wheel of an axial fluid flow turbine such that residual circumferential tightness is maintained between adjacent bucket assemblies at operating temperature and speed.

While only certain preferred features of the invention have been shown by way of illustration, many modifications and changes will occur to those skilled in the art. It is to be understood that the appended claims are intended to cover all such modifications and changes as fall within the true spirit and scope of the invention.

What is claimed is:

1. A method for assembling a plurality of bucket assemblies onto a wheel of a turbomachine, such that a predetermined circumferential force is obtainable on the plurality of bucket assemblies when assembled, the wheel defining at least one circumferentially extending dovetail wheel hook, the at least one wheel hook being relieved over a predetermined circumferential portion of the wheel to form a notch fo receiving bucket assemblies to be assembled onto the wheel, and the bucket assemblies including base portions respectively defining at least one dovetail bucket hook mateable with the at least one wheel hook, the base portions further defining lateral faces on opposite circumferential sides thereof which abut lateral faces of adjacent base portions when assembled onto the wheel, comprising:

reducing the distance between the lateral faces on the base portions of the plurality of bucket assemblies;

arranging the plurality of bucket assemblies onto the wheel;

disposing a closure piece having a base portion mateable with the relieved portion of the at least one wheel hook onto the wheel at the notch, the closure piece further defining lateral faces on opposite circumferential sides thereof which abut lateral faces of respective adjacent base portions when the closure piece is disposed on the wheel, the closure piece having a predetermined circumferential distance between the lateral faces of the closure piece whereby the predetermined circumferential force on the plurality of bucket assemblies may be obtained by appropriately sizing the predetermined distance between the lateral faces of the closure piece;

increasing the distance between the lateral faces on the base portions such that the lateral faces on the base portions exert the predetermined circumferential force on the plurality of bucket assemblies assembled on the wheel.

2. The method as in claim 1, wherein the step of reducing includes cooling the base portions of the plurality of bucket assemblies.

3. The method as in claim 2, wherein cooling includes disposing the base portions of the plurality of bucket assemblies in heat flow communication with dry ice.

4. The method as in claim 2 wherein cooling includes disposing the base portions of the plurality of bucket assemblies in heat flow communication with liquid nitrogen.

5. The method as in claim 1, wherein the step of increasing includes heating the base portions of the plurality of bucket assemblies.

6. The method as in claim 5, wherein heating includes disposing the base portions of the plurality of bucket assemblies in heat flow communication with ambient environment.

7. The method as in claim 1, further including securing the closure piece to at least one of the base portions adjacent the closure piece.

8. The method as in claim 2, wherein cooling includes cooling all base portions of the plurality of bucket assemblies to be arranged on the wheel.

9. The method as in claim 7, wherein cooling includes cooling all base portions of the plurality of bucket assemblies to be arranged on the wheel.

10. A method for assembling a plurality of bucket assemblies onto a wheel of a turbomachine such that a predetermined circumferential force is obtainable on the plurality of bucket assemblies when assembled, the wheel defining at least one circumferentially extending dovetail wheel hook, the at least one wheel hook being relieved over a predetermined circumferential portion of the wheel to form a notch for receiving bucket assemblies to be assembled onto the wheel, and the bucket assemblies including base portions respectively defining at least one dovetail bucket hook mateable with the at least one wheel hook, the base portions further defining lateral faces on opposite circumferential sides thereof which abut lateral faces of adjacent base portions when assembled onto the wheel, comprising:

increasing the circumferential expanse of the wheel;

arranging the plurality of bucket assemblies onto the wheel; and decreasing the circumferential expanse of the wheel, such that the lateral faces of the plurality of bucket assemblies are subjected to the predetermined circumferential force.

11. The method as in claim 10, wherein the step of increasing includes heating the wheel.

12. The method as in claim 11, wherein the step of heating includes heating the wheel to at least about 250° F.

13. The method as in claim 10, wherein the step of decreasing includes cooling the wheel.

14. The method as in claim 10, further including:

disposing a closure piece having a base portion mateable with the relieved portion of the at least one wheel hook onto the wheel at the notch, the closure piece further defining lateral faces on opposite circumferential sides thereof which abut lateral faces of respective adjacent base portions when the closure piece is disposed on the wheel, the closure piece having a predetermined circumferential distance between the lateral faces of the closure piece, whereby the predetermined circumferential force on the plurality of bucket assemblies may be obtained by appropriately sizing the predetermined circumferential distance between the lateral faces of the closure piece; and securing the closure piece to at least one of the base portions adjacent the closure piece.

15. A method for assembling a plurality of bucket assemblies onto a wheel of a turbomachine, such that a predetermined circumferential force is obtainable on the pluraliity of bucket assemblies when assembled, the wheel defining at least one circumferentially extending dovetail wheel hook, the at least one wheel hook being relieved over a predetermined circumferential portion of the wheel to form a notch for receiving bucket assemblies to be assembled onto the wheel, and the bucket assemblies including base portions respectively defining at least one dovetail bucket hook mateable with the at least one wheel hook, the base portions further defining lateral faces on opposite circumferential sides thereof which abut lateral faces of adjacent base portions when assembled onto the wheel, comprising:

increasing the circumferential expanse of the wheel;

cooling all base portions of the plurality of bucket assemblies to be arranged on the wheel.

arranging the plurality of bucket assemblies onto the wheel;

disposing a closure piece having a base portion mateable with the relieved portion of the at least one wheel hook onto the wheel at the notch, the closure piece further defining lateral faces on opposite circumferential sides thereof which abut lateral faces of respective adjacent base portions when the closure piece is disposed on the wheel, the closure piece having a predetermined circumferential distance between the lateral faces of the closure piece, whereby the predetermined circumferential force on the plurality of bucket assemblies may be obtained by appropriately sizing the predetermined circumferential distance between the lateral faces of the closure piece;

increasing the distance between the lateral faces on the base portions of the plurality of bucket assemblies; and, decreasing the circumferential expanse of the wheel, such that the lateral faces of the plurality of bucket assemblies are subjected to the predetermined circumferential force.

16. The method as in claim 15, further including securing the closure piece to at least one of the base portions adjacent the closure piece.

* * * * *